United States Patent [19]

Hauser et al.

[11] 4,086,006

[45] Apr. 25, 1978

[54] PURGING SYSTEM FOR A DEVELOPMENT APPARATUS

[75] Inventors: Oscar G. Hauser, Rochester; Frederick R. Ruckdeschel, Webster, both of N.Y.

[73] Assignee: Xerox Corporation, Stamford, Conn.

[21] Appl. No.: 728,101

[22] Filed: Sep. 30, 1976

[51] Int. Cl.[2] ..... G03G 15/00

[52] U.S. Cl. ..... 355/3 DD; 118/652; 355/4; 355/15

[58] Field of Search ..... 355/3 R, 4, 3 DD, 15; 118/652, 7, 8; 427/18; 96/1.2; 15/1.5, 256.51, 256.52

[56] References Cited

U.S. PATENT DOCUMENTS 3,926,517 12/1975 Nagahara ..... 355/3 DD

*Primary Examiner*—Richard L. Moses

*Attorney, Agent, or Firm*—J. J. Ralabate; C. A. Green; H. Fleischer

[57] ABSTRACT

An apparatus in which a latent image recorded on a member is developed with particles. The apparatus includes a housing having a chamber for storing a supply of particles therein. During the development process, particles are deposited on the latent image recorded on the member. These particles are purged from the chamber of the housing to permit particles of a different color to be disposed therein.

23 Claims, 4 Drawing Figures

PURGING SYSTEM FOR A DEVELOPMENT APPARATUS

BACKGROUND OF THE INVENTION

This invention relates to an electrostatographic printing machine, and more particularly concerns an improved development system for use therein.

An electrostatographic printing process forms an electrostatic latent image and reproduces the image in viewable form on a copy sheet. The field of electrostatography includes electrophotography and electrography. Electrophotography employs a photosensitive medium to form, with the aid of electromagnetic radiation, the electrostatic latent image. Electrography utilizes an insulating medium to form, without the aid of electromagnetic radiation, the electrostatic latent image. In both of the foregoing processes, the latent image is rendered viewable by the process of development, i.e, depositing particles on the latent image. Frequently, the particles are then transferred from the latent image to a copy sheet, or, in some processes, the recording sheet on which the latent image is produced, may serve also as the copy sheet after the particles have been deposited thereon. In either case, the resultant toner powder image deposited on the sheet is permanently affixed thereto by the process of applying heat and/or pressure. In the illustrative embodiment hereinafter described, an electrophotographic printing machine will be employed.

In electrophotographic printing, the photoconductive member is charged to sensitize its surface. The charged photoconductive member is exposed to a light image of the original document being reproduced. Exposure of the sensitized photoconductive surface discharges the charge selectively in the irradiated areas, in accordance with the light intensity. This creates an electrostatic latent image on the photoconductive surface corresponding to the original document being reproduced. Development of the electrostatic latent image recorded on the photoconductive surface is achieved by bringing a developer mix into contact therewith. Typically, a developer mix comprises dyed or colored heat settable plastic powders, known in the art as toner particles, which are mixed with coarse carrier granules, such as ferromagnetic granules. The toner particles and carrier granules are selected such that the toner particles acquire the appropriate charge relative to the electrostatic latent image recorded on the photoconductive surface. Thus, when the developer mix is brought into contact with the latent image recorded on the photoconductive surface, the greater attractive force thereof causes the toner particles to transfer from the carrier granules and adhere to the electrostatic latent image. This concept was originally disclosed by Carlson in U.S. Pat. No. 2,297,691 and is further amplified and described by many related patents in the art.

With the advent of multi-color electrophotographic printing, it became highly desirable to reproduce color originals as color copies or, even black and white originals as color copies. Heretofore, the process of color electrophotographic printing required the utilization of filters to form successive single color light images from the colored original document. These single color light images record successive single color electrostatic latent images on the photoconductive surface. Each single color electrostatic latent image is developed with toner particles of a color complementary to the color of the filtered light image. These toner powder images, each of a different color, are transferred to the copy sheet in superimposed registration with one another. Thereafter, the multi-layered toner powder image is permanently affixed to the copy sheet. This produces a multi-color copy from a colored original document. The foregoing is more fully described in U.S. Pat. No. 3,854,449 issued to Davidson in 1974.

Recently, it has become highly desirable to create flat color, i.e. a copy containing information in two or more colors. The foregoing may be achieved on a high speed electrophotographic printing machine by masking selected portions of the original document or utilizes two or more original documents and reproducing the information contained therein on a common copy sheet in different colors. Different colors in the electrophotographic printing machine may be achieved by changing the color of the toner particles employed in the development system. Thus, a black and white electrophotographic printing machine may be converted to a color printing machine simply by changing the color of the toner particles contained within the development system. This requires that the development housing be cleaned so as to have no residual toner particles therein prior to the introduction of the differently colored toner particles. This is necessary to prevent the contamination of the new charge of toner particles by the residual toner particles from the prior charge. For example, if the first charge of toner particles in the development system is black and the next charge red, the residual black toner particles would contaminate the red toner particles. It has been found that incomplete drainage of the developer housing of developer mix leaves a residual developer mix therein. This results in about a 2% to 3% contamination of the next charge of developer mix. When the developability of different species of toner particles on a carrier is about the same, the color difference caused by a 2% contamination results in borderline acceptability. However, where the first charge is dark and the second charge light, the contamination problem becomes more severe and 2% contamination level may not be acceptable.

Accordingly, it is a primary object of the present invention to improve purging of residual particles from the development system prior to the introduction of differently colored toner particles therein.

SUMMARY OF THE INVENTION

Briefly stated, and in accordance with the present invention, there is provided an apparatus for developing a latent image recorded on a member with particles.

Pursuant to the features of the present invention, there is provided a housing having a chamber therein for storing a supply of particles. Means, disposed in the chamber of the housing and arranged to be in communication with the latent image recorded on the member, deposit particles on the latent image. Means are provided for purging the particles from the chamber of the housing to permit particles of a different color to be disposed therein.

BRIEF DESCRIPTION OF THE DRAWINGS

Other objects and advantages of the present invention will become apparent upon reading the following detailed description and upon reference to the drawings, in which.

While the present invention will hereinafter be described in connection with the preferred embodiment and method associated therewith, it will be understood that it is not intended to limit the invention to that embodiment and method. On the contrary, it is intended to cover all alternatives, modifications, and equivalents as may be included within the spirit and scope of the invention as defined by the appended claims.

DETAILED DESCRIPTION OF THE INVENTION

Figure 1:
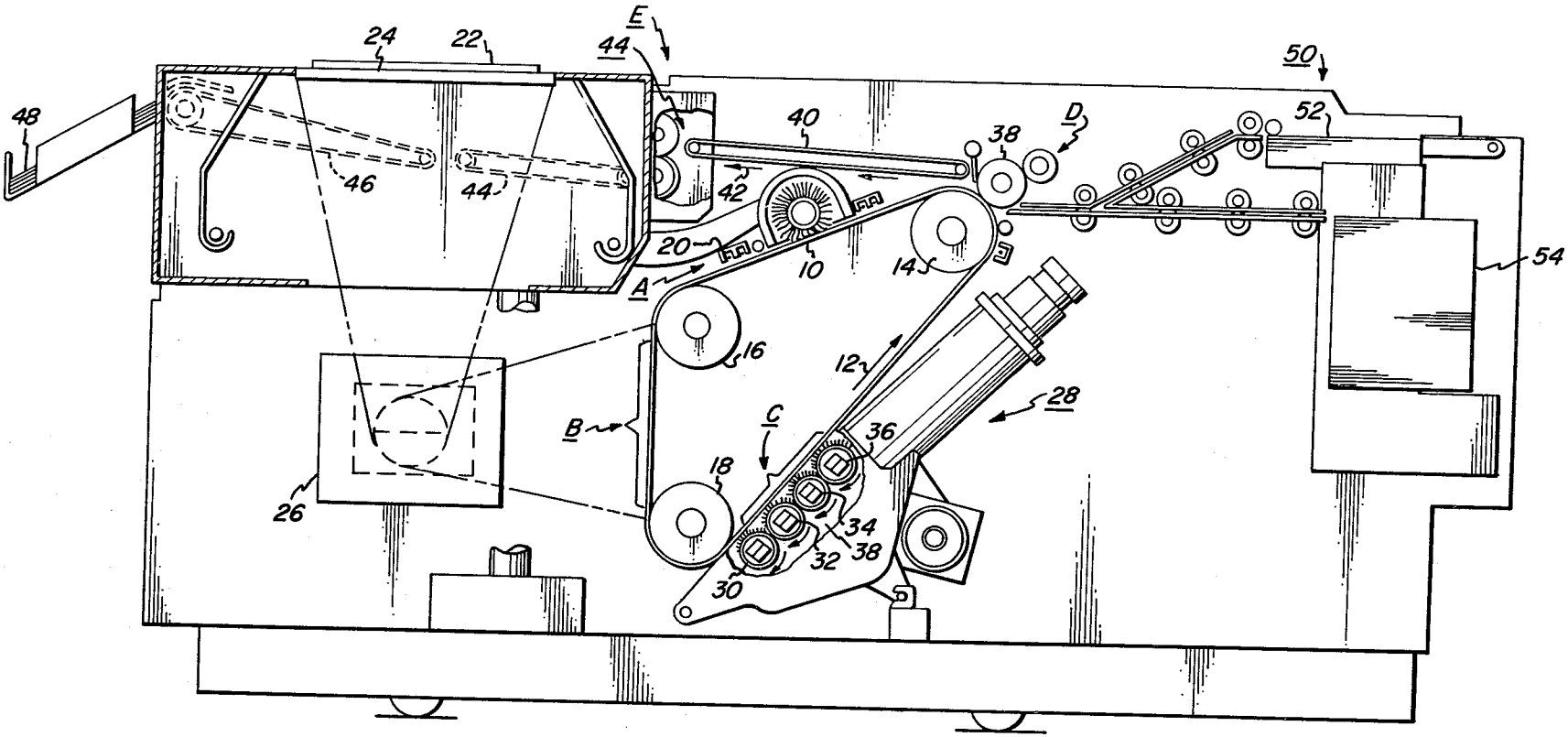
FIG. 1 is a schematic elevational view depicting an electrophotographic printing machine embodying the features of the present invention therein.

For a general understanding of the illustrative electrophotographic printing machine, in which the features of the present invention may be incorporated, reference is had to the drawings. In the drawings, like reference numerals have been used throughout to designate identical elements. FIG. 1 schematically illustrates the various components of a printing machine incorporating the development system and purging arrangement therefor. Although the purging mechanism is particularly well adapted for use in the development apparatus of an electrophotographic printing machine, it will become evident from the following discussion that it is equally well suited for use in a wide variety of electrostatographic printing machines and is not necessarily limited in its application to the particular embodiment shown herein.

Inasmuch as the art of electrophotographic printing is well known, the various processing stations employed in the FIG. 1 printing machine will be shown hereafter schematically and their operation described briefly with reference thereto.

As shown in FIG. 1, the electrophotographic printing machine employs a belt 10 having a photoconductive surface. By way of example, belt 10 may be made from a suitable selenium alloy deposited on a conductive substrate. Belt 10 moves in the direction of arrow 12 to advance sequentially through the various processing stations disposed thereabout. Rollers 14, 16, and 18 support belt 10. A drive mechanism, i.e. a suitable motor, is coupled to roller 14 so as to advance belt 10 in the direction of arrow 12.

Initially, a portion of belt 10 passes through charging station A. At charging station A, a corona generating device, indicated generally by the reference numeral 20, charges the photoconductive surface of belt 10 to a relatively high substantially uniform potential. A suitable corona generating device is described in U.S. Pat. No. 2,836,725 issued to Vyverberg in 1958.

Thereafter, the charged portion of belt 10 rotates through exposure station B. At exposure station B, an original document 22 is placed upon a transparent support platen 24 face down. An illumination system flashes light rays upon original document 22 to thereby produce image rays corresponding to the informational areas contained therein. The image rays are projected by means of an optical system 26 onto the charged portion of belt 10. In this way, the charged photoconductive surface of belt 10 is exposed to a light image of the original document. The exposure of the photocondconductive surface to the light image discharges the charge thereon in accordance with the intensity of the light image projected thereto. In this manner, there is an electrostatic latent image recorded on the photoconductive surface of the belt 10.

Next, the electrostatic latent image recorded on belt 10 is advanced to development station C. At development station C, developer unit 28 has a plurality of magnetic brushes 30, 32, 34 and 36 disposed in housing 38 to move developer material adjacent to the electrostatic latent image recorded on belt 10. The developer mix comprises carrier granules having toner particles adhering thereto. Generally, the carrier granules are formed from a ferromagnetic material while the toner particles are made from a heat settable plastic. In a typical magnetic brush system, a chain-like array of developer mix extends in an outwardly direction from each magnetic brush to contact the electrostatic latent image recorded on the photoconductive surface of belt 10. The latent image attracts electrostatically the toner particles from the carrier granules forming a toner powder image on belt 10.

The toner powder image is transported by belt 10 to transfer station D. Transfer station D is located at a point of tangency on belt 10 as it moves around roller 14. A transfer roller 38 is disposed at transfer station D with the copy sheet having the toner powder image thereon being interposed between transfer roller 38 and belt 10. Transfer roller 38 is electrically biased to a suitable magnitude and polarity so as to attract the toner powder image to the surface of the copy sheet in contact therewith. After transferring the toner powder image to the copy sheet, conveyor 40 advances the copy sheet in the direction of arrow 42 to fixing station E.

Fixing station E includes a fuser assembly, indicated generally by the reference numeral 44. Fuser assembly includes a heated fuser roll and a back-up roll. The surface of the copy sheet having the toner powder image thereon passed between the fuser roll and backup roll with the toner powder image contacting the fuser roll. In this manner, the toner powder image is permanently affixed to the copy sheet. After fusing, conveyors 44 and 46 advance the copy sheet to catch tray 48.

Turning now to the sheet feeding apparatus, sheet transport 50 advances, in seriatim, successive copy sheets from stack 52 or, in lieu thereof, stack 54. The machine programming permits the operator to select the desired stack from which the copy sheet will be advanced. In this way, the selected copy sheet is advanced to transfer station D where the toner powder image is transferred thereto.

It is believed that the foregoing description is sufficient for purposes of the present application to illustrate the general operation of an electrophotographic printing machine incorporating the features of the present invention therein. Referring now to the specific subject matter of the present invention, FIGS. 2 through 4, inclusive, depict purging of the development apparatus employed in the FIG. 1 printing machine.

Figure 2:
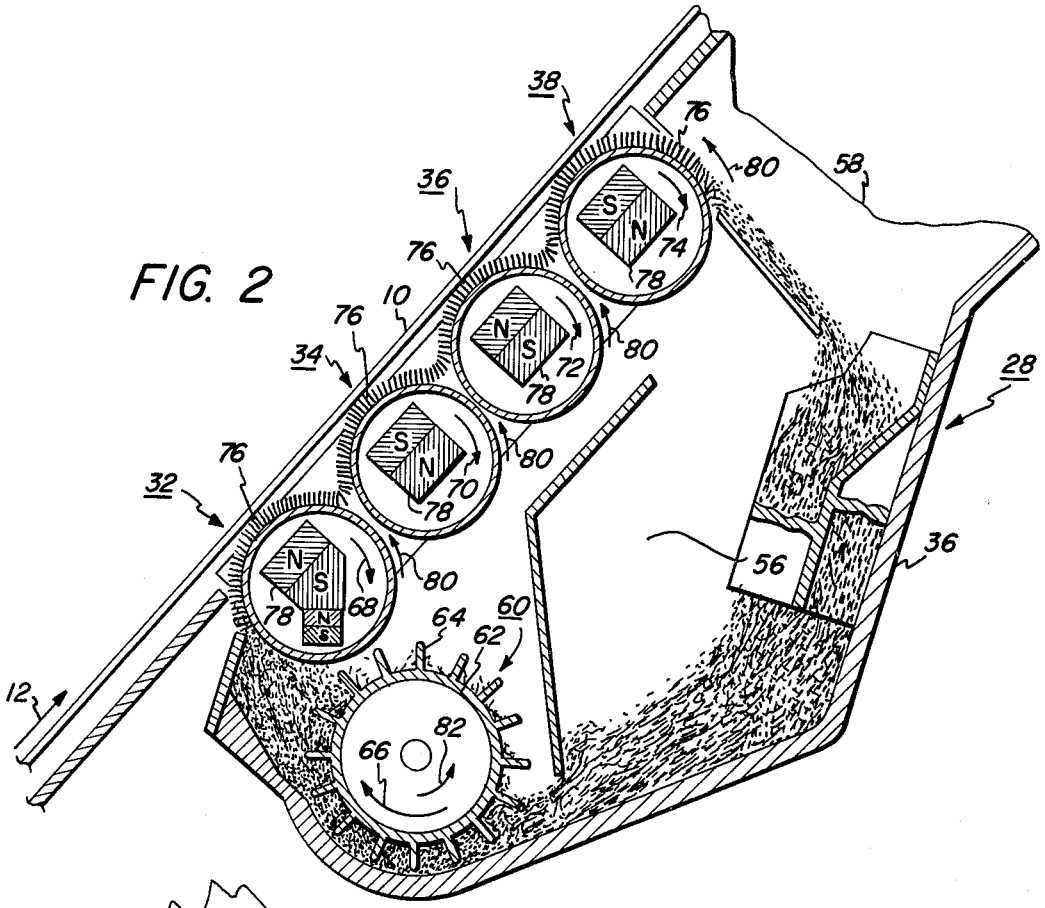
FIG. 2 is a sectional elevational view showing the development system used in the FIG. 1 printing machine.

Turning now to FIG. 2, there is shown the detailed structure of developer unit 28. As shown therein, housing 36 has a chamber 56 for storing a supply of developer mix therein. Toner particles are added to the developer mixture, as required, from a toner dispenser in communication with housing 28 at aperture 58. The container for storing additional toner particles (not shown) is removable. In this manner, a container having cleaning particles therein may be positioned at aperture 58 to dispense cleaning particles into chamber 56 of housing 36.

Paddle wheel 60 includes a substantially tubular member 62 having vane 64 extending in a radial direction outwardly therefrom. Paddle wheel 60 rotates in the direction of arrow 66 to advance the developer mix to magnetic brush 32. Magnetic brushes 32, 34, 36 and 38 form a blanket of developer mix moving in the direction of arrow 12 and closely positioned adjacent to the latent image recorded on belt 10. In this manner, the toner particles are attracted electrostatically from the carrier granules to the latent image in image configuration. Each developer unit rotates, in the normal mode of operation in the direction of arrows 68, 70, 72 and 74, respectively. After an original document has been reproduced in a first color, for example black, the next successive original document may be reproduced in a second or different color on the same or another copy sheets. Changing developer mix colors requires purging the initial developer mix from chamber 56 of housing 36.

Mounted for rotation within chamber 56 of housing 36 are four magnetic brushes 32, 34, 36 and 38 positioned with their axes in parallel and below belt 10. Each magnetic brush comprises an outer cylinder or tubular member 76 made of non-magnetizable material and extending almost the length of housing 36. Tubular members 76 are mounted for rotation in housing 36. Disposed within each tubular member 76 is a bar magnet 78. The only distinction between each magnetic brush is the polarity of the bar magnet. Thus, magnetic brush 32 has the polarity of bar magnet 78 oriented in one direction while magnetic brush 34 has the polarity of bar magnet 78 oriented in the opposite direction. Magnetic brush 36 has the polarity of bar magnet 78 oriented in the same direction as magnetic brush 32. Magnetic brush 38 has the polarity of bar magnet 78 oriented in the same direction as magnetic brush 34. As shown in FIG. 2, the peripheral walls of tubular member 76 are relatively close to each other. During a development cycle, tubular members 76 rotate in unison with the respective magnetic bars 78 held substantially stationarily. The magnetic field emanating from bar magnets 78 cause the developer mix to be attracted to the upper surface of tubular members 76. As the tubular members rotate in the direction of arrows 68, 70, 72, and 74, respectively, the developer mix advances across the upper surface of each tubular member 78. In this manner, the bristle of developer mix extend in an outwardly direction from housing 36 in contact with the electrostatic latent image recorded on belt 10. After passing magnetic brush 38 the remaining developer mix returns to chamber 56 of housing 36.

Figure 4:
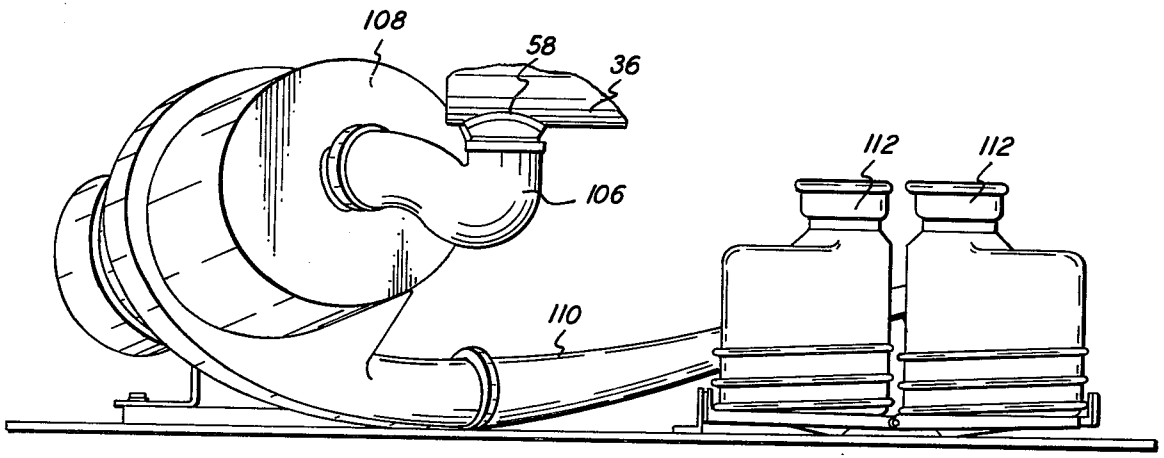
FIG. 4 is a schematic perspective view depicting the system for removing particles from the FIG. 2 development system.

In purging developer unit 28, the developer mix is drained from chamber 56 of housing 36 through aperture 58 by a vacuum blower system such as is shown in FIG. 4. The vacuum blower system will be discussed hereinafter in greater detail. After the developer mixture of the first color is drained from chamber 56 of housing 36, cleaning particles such as fine particles of unprocessed magnetic or Toniolo steel are introduced into chamber 56 of housing 36 via aperture 58. Thereafter, the direction of rotation of tubular members 76 are reversed so that each tubular member rotates in the direction of arrow 80. This forms a blanket of cleaning particles on the under surface of tubular member 76 moving in the opposite direction, i.e., away from the walls of chamber 56 of housing 36. Moreover, the direction of rotation of paddle wheel 60 is also reversed so that paddle wheel 60 rotates in the direction of arrow 82. In this way, the cleaning particles are continually moved away from the walls of the housing. Moreover, a cloud of cleaning particles is created inside of the chamber 56 of housing 36 so that all parts thereof contact the moving cleaning particles. In this manner, the residual toner particles are attracted to the cleaning particles. Preferably, the cleaning particles are about 100 microns in size. In addition, the cleaning particles have a low permeability which prevents the material from adhering strongly to tubular member 76. The high rotational speed of tubular member 76 and paddle wheel 60 provide a "sand blasting" effect. It should be noted that housing 36 moves to an inoperative position away from photoconductive belt 12 during the purging operation so as to prevent inadvertent spraying of belt 10 with cleaning particles. In addition, a shutter mechanism may be interposed over the aperture in housing 36 so as to prevent the cleaning particles escaping therefrom. It should be noted, that during the purging operation not only are tubular members 76 rotated in the opposite direction from their normal mode of operation, but paddle wheel 60 is also rotated in the opposite direction. In addition, each magnetic bar 78 is reversed so that the polarity thereof is opposite to that of the normal operating mode. This enables the blanket of cleaning particles to form on the undersurface of tubular members 76 and move in an opposite direction from the normal movement of the developer mix.

Figure 3:
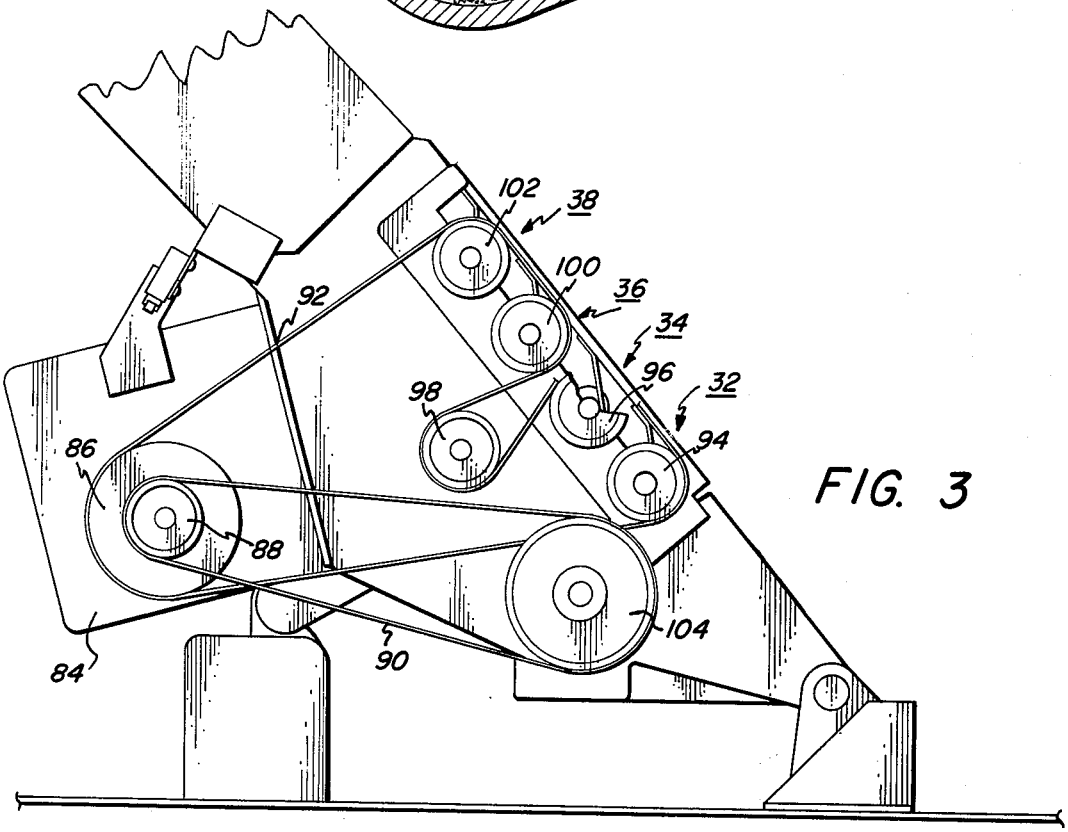
FIG. 3 is an elevational view illustrating the drive system for the FIG. 2 development system.

Referring now to FIG. 3, the rotational motion for all of the rotary components of developing apparatus 28 will be described. The drive system includes a motor 84, a pulley 86 secured to the motor shaft, a smaller pulley 88 also secured to the motor shaft and timing belts 90, 92 for connecting pulleys 86 and 88, respectively, to the rotary components. Specifically, belt 92 is drivingly engageable with pulleys 94 and 96 mounted on the drive shafts of tubular member 76 of magnetic brushes 32 and 34, respectively. An idler pulley 98 and pulleys 100 and 102 secured to the drive shafts of tubular members 76 of magnetic brushes 36 and 38, respectively, are also in driving engagement with belt 92. Belt 90 connects drive pulley 88 with pulley 104 secured to the shaft of paddle wheel 60, thereby insuring that the paddle wheel and magnetic brush tubular members move in unison with one another. In this manner, tubular members 76 rotate in the direction of arrows 68, 70, 72 and 74, respectively, in the normal mode of operation, while rotating in the direction of arrow 80 in the purging mode of operation. Similarly, paddle wheel 60 rotates in the direction of arrow 66 in the normal mode of operation, and in direction of arrow 82 in the purging mode of operation. The reverse direction of rotation for the foregoing elements may be achieved by reversing the direction of rotation of motor 84 through a suitable coupling arrangement which is switchable on and off. An exemplary coupling arrangement positions idler gear between motor 84 and pulley 88 while removing the gear at other times so as to change the direction of rotation. Once again, magnets 78 must also be reversed 180° when switching from the normal mode of operation to the purging mode. This may be achieved automatically by a cam arrangement which rotates each magnetic bar 180° when switching from an operating mode to a purging mode.

Referring now to FIG. 4, the system for removing the cleaning particles and developer mix from the chamber 56 of housing 36 is described herein in greater detail. As shown, duct 106 is coupled to aperture 58 of housing 36. Motor driven blower or fan 108 coupled to duct 106 has an impeller mounted for rotation therein and is arranged to remove air and developer mix from chamber 56 of housing 36 through duct 106 and out again through duct 110 to containers 112. Thus, the cleaning or purging operation requires removing the initial charge of developer mix from chamber 56 of housing 36. After this process is completed, cleaning particles of fine magnetite or Toniolo steel are introduced into chamber 56 of housing 36. At this time paddle wheel 60 and tubular member 76 of each magnetic brush are rotated in opposite directions from their normal mode of operation. In addition, each bar magnet is rotated 180°. In this way, a cloud of cleaning particles is formed contacting the walls of chamber 56 of housing 36 so as to attract the residual toner particles thereto. After a suitable period of time, duct 106 is coupled to housing 36 and blower 108 activated so as to remove the cleaning particles with the residual toner particles adhering thereto from the chamber 56. The particles are sucked through the system and stored in containers 112. After cleaning chamber 56 of housing 36, a new charge of developer mix, in a new color, may be introduced into chamber 56 for subsequent use in the printing machine to develop the latent image in a new color.

It is, therefore, evident that there has been provided in accordance with the present invention, an apparatus and method of purging developer mix from a developer housing to permit the introduction of a new developer mix containing toner particles of a different color therein. The apparatus and method of the present invention fully satisfied the objects, aims and advantages hereinbefore set forth. While this invention has been described in conjunction with a specific embodiment and method thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. An apparatus for developing a latent image recorded on a member with developer particles, including:

a housing defining a chamber for storing a supply of developer particles therein;

means, disposed in the chamber of said housing and arranged to be in communication with the latent image recorded on the member, for depositing developer particles on the latent image; and means for cleaning the developer particles from the chamber of said housing to permit developer particles of a different color to be disposed therein.

2. An apparatus as recited in claim 1, wherein said cleaning means includes:

means for removing the developer particles from the chamber of said housing;

means for introducing cleaning particles into the chamber of said housing; and means for agitating the cleaning particles to form a cloud thereof attracting the residual developer particles thereto.

3. An apparatus as recited in claim 2, wherein said depositing means includes a plurality of magnetic developing brushes, said magnetic developing brushes moving the developer particles in a first direction to deposit the developer particles on the latent image and moving the cleaning particles in a second direction opposed to the first direction to attract the residual developer particles thereto.

4. An apparatus as recited in claim 3, wherein said removing means includes:

a vacuum blower coupled to the chamber of said housing and arranged to form a flow of cleaning particles and residual developer particles from the chamber of said housing; and a first container coupled to said blower to receive the cleaning particles and residual developer particles evacuated from the chamber of said housing.

5. An apparatus as recited in claim 4, wherein each of said plurality of magnetic developing brushes includes:

a tubular member of non-magnetic material;

magnetic means disposed within said tubular member for creating a magnetic field in the path of said tubular member;

means for rotating said tubular member in a first direction to move the developer particles in the first direction and in the second direction opposed to the first direction of rotation, to move the cleaning particles in the second direction.

6. An apparatus as recited in claim 5, further including means associated with said magnetic means to rotate said magnetic means about 180° to reverse the polarity thereof from moving the developer particles in the first direction to moving the cleaning particles in the second direction.

7. An apparatus as recited in claim 6, wherein said agitating means includes a paddle wheel mounted rotatably in the chamber of said housing.

8. An apparatus as recited in claim 7, wherein said introducing means includes a second container storing a supply of cleaning particles therein and being arranged to be postioned in communication with the chamber of said housing.

9. An apparatus as recited in claim 8, wherein the cleaning particles include fine particles of magnetite.

10. An electrostatographic printing machine of the type having a latent image recorded on a member wherein the improved development system includes:

a housing defining a chamber storing a supply of developer mix therein comprising carrier granules and toner particles;

means, disposed in the chamber of said housing and arranged to be in communication with the latent image recorded on the member, for depositing toner particles on the latent image; and means for cleaning the developer mix from the chamber of said housing to permit a developer mix of a different color to be disposed therein.

11. A printing machine as recited in claim 10, wherein said cleaning means includes:

means for removing the developer mix from the chamber of said housing;

means for introducing cleaning particles into the chamber of said housing; and means for agitating the cleaning particles to form a cloud thereof attracting the residual toner particles thereto.

12. A printing machine as recited in claim 11, wherein said depositing means includes a plurality of magnetic developing brushes, said magnetic developing brushes moving the developer mix in a first direction to deposit the toner particles on the latent image and moving the cleaning particles in a second direction opposed to the first direction to attract the residual toner particles thereto.

13. A printing machine as recited in claim 12, wherein said removing means includes:

a vacuum blower coupled to the chamber of said housing and arranged to form a flow of cleaning particles and toner particles from the chamber of said housing; and a first container coupled to said blower to receive the cleaning particles and residual toner particles evacuated from the chamber of said housing.

14. A printing machine as recited in claim 13, wherein each of said plurality of magnetic developing brushes includes:

a tubular member of non-magnetic material;

magnetic means disposed within said tubular member for creating a magnetic field in the path of said tubular member;

means for rotating said tubular member in a first direction to move the developer mix in the first direction and in the second direction opposed to the first direction of rotation, to move the cleaning particles in the second direction.

15. A printing machine as recited in claim 14, wherein said agitating means includes a paddle wheel mounted rotatably in the chamber of said housing.

16. A printing machine as recited in claim 15, further including means associated with said magnetic means to rotate said magnetic means about 180° to reverse the polarity thereof from moving the developer mix in the first direction to moving the cleaning particles in the second direction.

17. A printing machine as recited in claim 16, wherein said introducing means includes a second container storing a supply of cleaning particles therein and being arranged to be positioned in communication with the chamber of said housing.

18. A printing machine as recited in claim 17, wherein the cleaning particles include fine particles of magnetite.

19. A method of purging residual particles from a developer housing having a chamber for storing a supply thereof, including the steps of:

removing the particles from the chamber of the housing with residual particles remaining therein;

adding cleaning particles to the chamber of the housing; and agitating the cleaning particles to form a cloud thereof attracting the residual particles in the chamber of the housing thereto.

20. A method as recited in claim 19, further including the step of rotating the magnetic brush assembly in a direction opposed to the operative direction of rotation thereof.

21. A method as recited in claim 20, wherein said step of agitating includes rotating a paddle wheel in the chamber of the housing.

22. A method as recited in claim 21, further including the step of rotating the bar magnet in each tubular member of the magnetic brush assembly 180° to reverse the polarity thereof.

23. A method as recited in claim 22, further including the step of moving the housing to an inoperative location prior to initiating the cleaning process.

* * * * *